US008215503B2

(12) United States Patent
Appel et al.

(10) Patent No.: US 8,215,503 B2
(45) Date of Patent: Jul. 10, 2012

(54) CRANE WITH TELESCOPIC BOOM

(75) Inventors: Jürgen Appel, Ehingen (DE); Thomas Krebs, Blieskastel (DE); Achim Schütz, Dellfeld (DE)

(73) Assignee: Terex-Demag GmbH (DE)

( * ) Notice: Subject to any disclaimer, the term of this patent is extended or adjusted under 35 U.S.C. 154(b) by 368 days.

(21) Appl. No.: 12/447,184

(22) PCT Filed: Oct. 24, 2008

(86) PCT No.: PCT/DE2008/001784

§ 371 (c)(1),
(2), (4) Date: Jun. 1, 2009

(87) PCT Pub. No.: WO2009/056122

PCT Pub. Date: May 7, 2009

(65) Prior Publication Data

US 2011/0049077 A1 Mar. 3, 2011

(30) Foreign Application Priority Data

Oct. 31, 2007 (DE) ..... 10 2007 052 954

(51) Int. Cl.
*B66C 23/04* (2006.01)

(52) U.S. Cl. ..... 212/349; 212/264; 212/292

(58) Field of Classification Search ..... 212/230, 212/264, 292, 296, 347, 348, 349, 350
See application file for complete search history.

(56) References Cited

U.S. PATENT DOCUMENTS 3,841,494 A * 10/1974 Chalupsky et al. ..... 212/349
3,921,819 A * 11/1975 Spain ..... 212/349
4,394,108 A * 7/1983 Cook et al. ..... 414/680

(Continued)

FOREIGN PATENT DOCUMENTS

| | | | |
|---|---|---|---|
| DE | 102006023371 | A1 | 11/2007 |
| EP | 0476225 | A2 | 3/1992 |
| EP | 0 984 895 | | 4/2002 |
| WO | WO2007052339 | A1 | 5/2007 |

OTHER PUBLICATIONS

International Search Report; International Application No. PCT/DE2008/001784; International Filing Date: Oct. 24, 2008; Date of Mailing: Jan. 20, 2009, 3 pages.

(Continued)

*Primary Examiner* — Emmanuel M Marcelo
(74) *Attorney, Agent, or Firm* — Cantor Colburn LLP

(57) ABSTRACT

A crane having a telescoping boom whose sections, are arranged in a base boom that can telescope individually, in and out, after disengaging locking pin connections that are secured in the respective moved out or moved in positions by locking pins. A guide profile head is arranged at an end remote of the articulation of the safety locking unit to the inner end of the base boom. To lengthen the boom without substantially changing the telescopic system itself, the guide profile head is detachably fastened to the safety locking unit. An additional guide frame, whose length is dimensioned corresponding to the length of the telescoping boom that has been expanded by additional sections inserted in the telescoping boom, is mounted in place of the guide profile head, and that a guide profile head can be arranged at the free end of the guide frame.

6 Claims, 4 Drawing Sheets

50-meter main boom

U.S. PATENT DOCUMENTS

| | | | | |
|---|---|---|---|---|
| 4,634,337 | A * | 1/1987 | Hamman | 414/563 |
| 5,695,082 | A | 12/1997 | Rainwater | |
| 6,189,712 | B1 | 2/2001 | Conrad et al. | |
| 6,601,719 | B2 * | 8/2003 | Harrington | 212/292 |
| 7,044,315 | B2 * | 5/2006 | Willim | 212/299 |
| 2010/0038333 | A1 | 2/2010 | Conrad et al. | |

OTHER PUBLICATIONS

English Translation of Written Opinion of International Searching Authority; International Application No. PCT/DE2008/001784; International Filing Date: Oct. 24, 2008; Date of Mailing: Apr. 30, 2010, 5 pages.

* cited by examiner 100-meter main boom 50-meter main boom

CRANE WITH TELESCOPIC BOOM

PRIORITY CLAIM

This is a U.S. national stage of application No. PCT/DE2008/001784, filed on 24 Oct. 2008. Priority is claimed on the following application: Country: Germany, Application No.: 10 2007 052 954.8, filed: 31 Oct. 2007; the content of both being incorporated herein by reference.

BACKGROUND OF THE INVENTION

1. Field of the Invention

The invention is directed to a crane with a telescoping boom whose sections are arranged in a base boom and that can telescope in and out individually, by a hydraulic piston-cylinder unit after disengaging locking pin connections. The sections are secured in the respective moved out or moved in positions by locking pins. A piston rod of the piston-cylinder unit is articulated by its rear end to the inner end of the base boom, and a safety locking unit connectable to recesses in the telescoping sections is fastened to the inner end and outer end of a displaceable cylinder housing, and a guide profile head is arranged at a remote end of the articulation of the safety locking unit to the inner end of the base boom.

2. Prior Art

A crane of the type mentioned above is known from EP 0 984 895 B1.

In practice, main booms with a length of 50 meters can be realized.

DE 10 2006 023 371 A1 discloses a head piece of a final boom section be constructed such that additional boom sections can be inserted through this head piece so that all of the sections can achieve greater boom lengths when telescoping, for example, a twofold increase to 100 meters.

SUMMARY OF THE INVENTION

An object of the present invention is to lengthen the boom without substantially changing the telescopic system itself, such as the safety locking unit.

In a crane with a telescoping boom whose sections are arranged in a base boom and can telescope individually, the telescoping boom can move in and out by a hydraulic piston-cylinder unit after disengaging locking pin connections. The sections are secured in the respective moved out or moved in positions by locking pins The piston rod of the piston-cylinder unit is articulated by its rear end to the inner end of the base boom, and a safety locking unit connectable to recesses in the telescoping sections is fastened to the inner end and outer end of the displaceable cylinder housing. A guide profile head is arranged at the end remote of the articulation of the safety locking unit to the inner end of the base boom. The guide profile head is fastened to the safety locking unit in such a way that it can be dismantled, and an additional guide frame, whose length is dimensioned corresponding to the length of the telescoping boom that has been expanded by additional sections inserted in the telescoping boom is mounted in place of the guide profile head, and a guide profile head is arranged at the free end of the guide frame.

The guide profile head, which is dismantled from the safety locking unit, is preferably fastened to the guide frame. However, it is also possible to arrange the guide profile head in a fixed manner at the guide frame so that the guide profile head and the guide frame both form a unit that can be assembled and disassembled.

According to one embodiment of the invention main boom sections are economized because an expansion of a boom to 100 meters can be achieved or, in a corresponding manner, a boom can be restored to 50 meters in a simple manner.

Further, there is a savings in the cylinder weight of the piston-cylinder unit and smaller pipe wall thicknesses are possible because the required lift is smaller. In this connection, smaller buckling lengths of the cylinder are achieved. Accordingly, a variable maximum telescoping length can be achieved using less material. Compared to conventional cranes with maximum main boom lengths of, e.g., 100 meters, a variable basic unit comprising a configuration with a base boom of, e.g., 50 meters can be used as a basic crane at any time. By inserting an added boom unit or additional telescopic sections which can be inserted into the basic unit, the basic crane of 50 meters becomes a crane with a main boom having a maximum length of 100 meters. Naturally, other lengths are also possible because the length of the guide frame can be adapted to the lengthening of the boom by means of the additionally inserted sections.

BRIEF DESCRIPTION OF THE DRAWINGS

The invention will be described in the following with reference to the drawings.

DETAILED DESCRIPTION OF THE DRAWINGS

Figure 1:
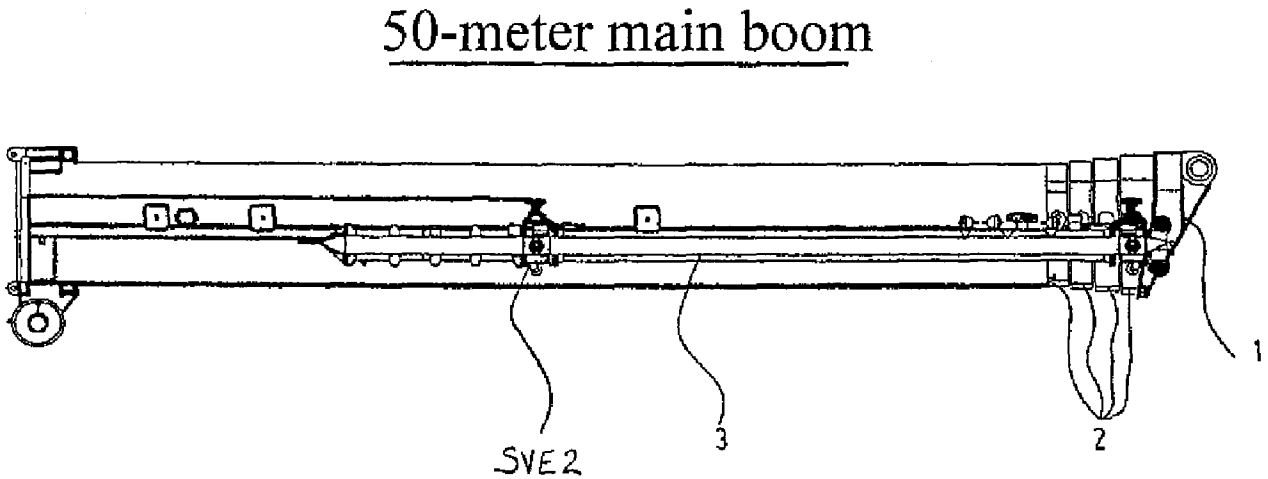
FIG. 1 is a schematic view of a main boom of 50 meters.
Figure 2:
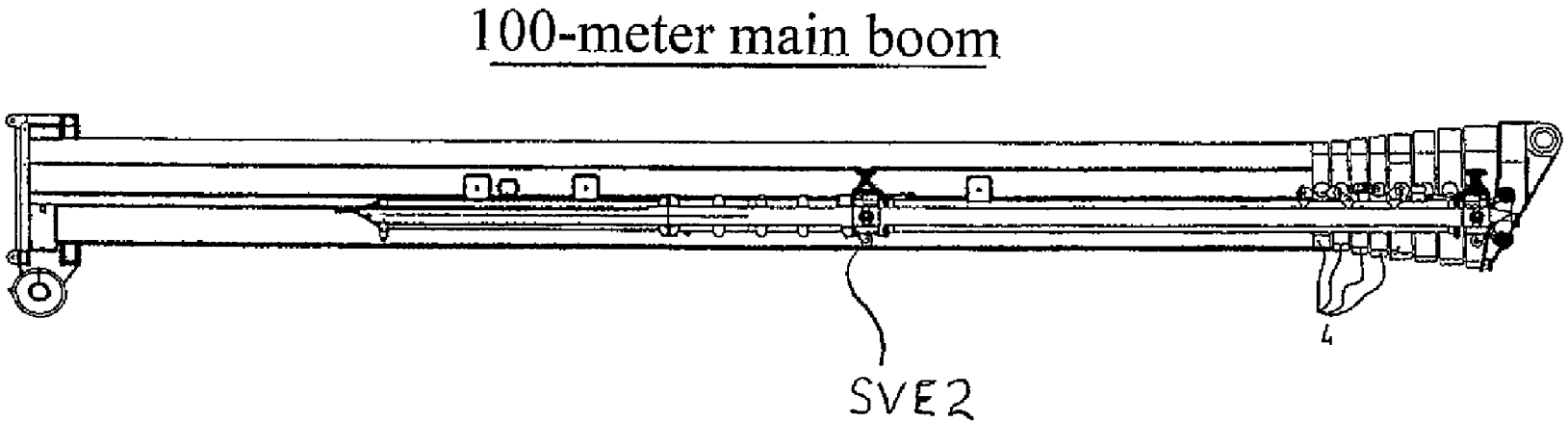
FIG. 2 is a corresponding view of a main boom of 100 meters.
Figures 3A, 3B:
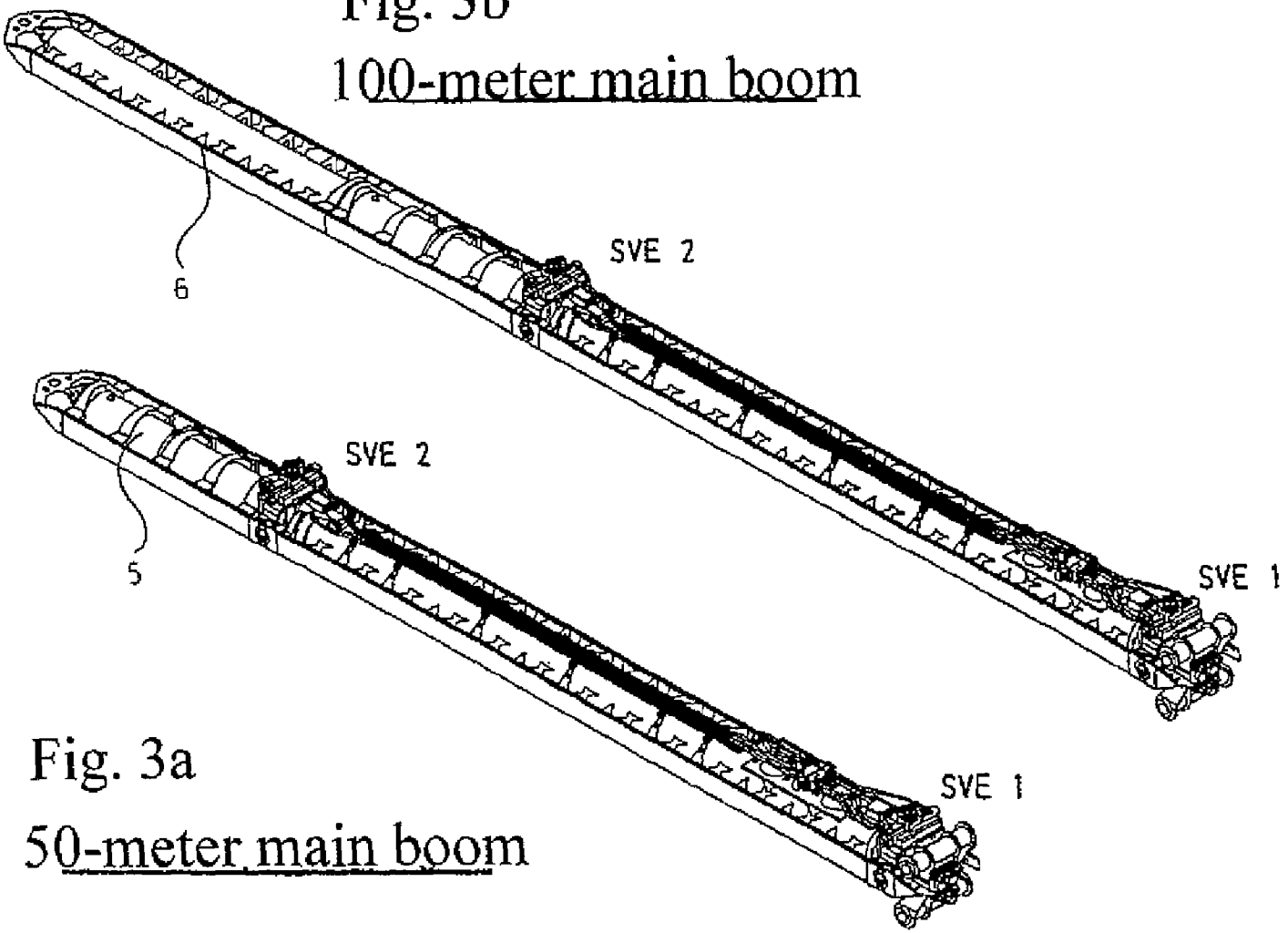
FIGS. 3*a* and 3*b* illustrate the adaptation by means of a guide frame.

FIGS. 1 and 2 show the innermost box or section of the telescoping boom with the safety locking unit SVE 2 arranged therein. A comparison of FIGS. 1 and 2 shows that this telescopic system comprising the safety locking unit SVE 2 remains unchanged in both variants. On the other hand, a corresponding comparison of FIGS. 3*a* and 3*b* shows that a new, longer guide frame 6 has been arranged in place of the guide profile head 7 as shown in detail in FIG. 4 at the guide frame.

Guide frame 6 is adaptable to the boom length, i.e., it is adapted to the lengthening which is carried out. The guide profile head 7 is detachably connected to the guide frame 5 and is detached from the guide frame 5 and replaced by guide frame 6 when converting from the 50-meter main boom to the 100-meter main boom. Diverse combinations of base boxes and main boom boxes can be realized by not using only one variable safety locking unit SVE. The safety locking units SVE need no longer necessarily be positioned at the end of the piston-cylinder unit, but may be arranged in more or less any desired manner in the base box. One or more safety locking units SVE can be controlled independently from one another so that the previous rigid telescopic system is made flexible.

After the longer guide frame 6 is fastened, it is completed at its free end by a guide profile head 7. This guide profile head 7 is preferably the guide profile head 7 that was previously disassembled from guide frame 5, or a different guide profile head 7 together with the guide frame 6 forms a unit which is then used in the lengthening.

Figure 4:
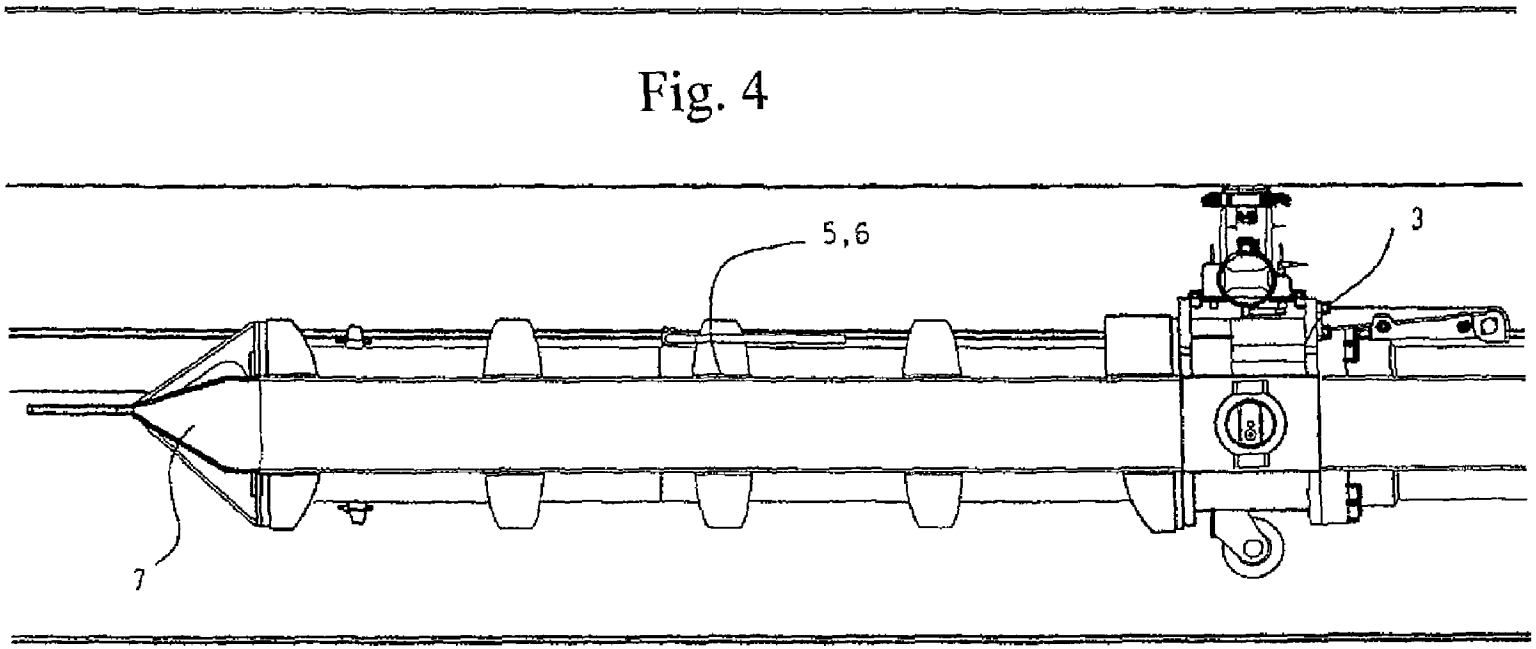
FIG. 4 is a detailed view of the safety locking unit.

As shown in FIG. 1, the base box 1 includes telescoping boxing or sections for a 50 meter boom. FIG. 2 shows additional telescope and boxes or sections for a 50 meter boom. FIGS. 3*a* and 3*b* depict a 50 meter boom and 100 meter boom according to one embodiment of the invention. As shown on, each boom includes a first safety locking unit SVE 1 at a first end of the telescoping boom and second locking unit SVE 2 at a second end of the telescoping boom remote from the base box 1. As shown in FIG. 4, the telescoping unit with SVE 2 is shown with the guide frame and guide profile head extending therefrom.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A telescoping boom crane comprising:

a base boom configured to articulate at a first end;

a plurality of boom sections arranged in the base boom, each of the plural boom sections configured to individually move telescopically in and out;

a plurality of locking pins configured to secure each of plural boom sections in a moved in position or a moved out position;

a hydraulic piston-cylinder unit configured to move each of the plural boom section after disengaging at least one of the plural locking pins, the hydraulic piston-cylinder unit comprising:

a displaceable cylinder housing; and a piston rod coupled by a first end to an inner end of the base boom and arranged in the displaceable cylinder housing;

a safety locking unit coupled to recesses in the plural boom sections and to an inner end and outer end of the displaceable cylinder housing configured to engage and disengage the plural locking pins from the plural boom sections;

a first guide frame coupled to the safety locking unit;

an additional guide frame whose length is based at least in part on an overall length of the plural boom sections, the additional guide frame having a first additional guide frame end and a second additional guide frame end longitudinally opposite the first additional guide frame end, the additional guide frame coupled at the first additional guide frame end to a second end of the first guide frame longitudinally opposite the first end of the first guide frame; and a guide profile head configured to be detachably fastened to one of the second end of the first guide frame and the second additional guide frame end.

2. The telescoping boom crane according to claim 1, wherein the guide profile head is further configured to be coupled to the safety locking unit.

3. The telescoping boom crane according to claim 1, wherein the overall length of the plural boom sections is greater than 50 meters.

4. The telescoping boom crane according to claim 3, wherein the overall length of the plural boom sections is about 100 meters.

5. The telescoping boom crane according to claim 1, further comprising an additional safety locking unit arranged at the first end of the base boom.

6. The telescoping boom crane according to claim 5 wherein the safety locking unit and the additional safety locking unit are independently controlled.

* * * * *